US011559830B2

(12) United States Patent
Fischer et al.

(10) Patent No.: US 11,559,830 B2
(45) Date of Patent: Jan. 24, 2023

(54) ROLL STAND HAVING A HYBRID COOLING DEVICE

(71) Applicant: Primetals Technologies Austria GmbH, Linz (AT)

(72) Inventors: Markus Fischer, St. Pantaleon-Erla (AT); Erich Opitz, Linz (AT); Lukas Pichler, Linz (AT); Christoph Proell, Feldkirchen (AT); Alois Seilinger, Linz (AT)

(73) Assignee: PRIMETALS TECHNOLOGIES AUSTRIA GMBH

( * ) Notice: Subject to any disclaimer, the term of this patent is extended or adjusted under 35 U.S.C. 154(b) by 0 days.

(21) Appl. No.: 17/261,205

(22) PCT Filed: Jul. 4, 2019

(86) PCT No.: PCT/EP2019/067939

§ 371 (c)(1),
(2) Date: Jan. 19, 2021

(87) PCT Pub. No.: WO2020/020592

PCT Pub. Date: Jan. 30, 2020

(65) Prior Publication Data

US 2021/0245214 A1 Aug. 12, 2021

(30) Foreign Application Priority Data

Jul. 26, 2018 (EP) ..... 18185862

(51) Int. Cl.
*B21B 27/10* (2006.01)

(52) U.S. Cl.
CPC ..... *B21B 27/10* (2013.01); *B21B 2027/103* (2013.01)

(58) Field of Classification Search
CPC ... B21B 27/10; B21B 2027/103; B21B 37/32; B21B 32/74; B21B 45/0269; B21B 45/0275; B21B 45/0278; B21B 45/0281
See application file for complete search history.

(56) References Cited

U.S. PATENT DOCUMENTS 5,212,975 A * 5/1993 Ginzburg ..... B21B 27/10 72/11.3
5,799,523 A 9/1998 Seidel et al. ..... 72/9.3
(Continued)

FOREIGN PATENT DOCUMENTS

CN 1151914 A 6/1997
CN 102421541 A 4/2012
(Continued)

OTHER PUBLICATIONS

International Search Report dated Aug. 9, 2019 in corresponding PCT International Application No. PCT/EP2019/067939.
(Continued)

*Primary Examiner* — Jessica Cahill
*Assistant Examiner* — Jared O Brown
(74) *Attorney, Agent, or Firm* — Ostrolenk Faber LLP

(57) ABSTRACT

A roll stand (1) for rolling flat rolling stock (2) includes an upper working roller (3) and a lower working roller (4) that form a roll gap (5) between each other. The flat rolling stock (2) runs through the roll gap (5) in a transport direction (x) during rolling of the flat rolling stock (2). An upper cooling device (8), cools the upper working roller (3) and is arranged on the outlet side of the roll stand (1). The upper cooling device (8) has an upper spray boom (17), which extends parallel to the upper working roller (3) and has a plurality of upper spray nozzles (22), which spray a liquid coolant (12) onto the upper working roller (3). The upper cooling device (8) also has a lower spray boom (18), which extends parallel to the upper working roller (3) and has a plurality of lower spray nozzles (23), which spray the liquid coolant (12) onto the upper working roller (3). The lower spray boom (18) is arranged between the flat rolling stock (2) and the upper spray boom (17). At least some of the upper spray nozzles
(Continued)

(22) are flat jet nozzles, and at least some of the lower spray nozzles (23) are full jet nozzles.

5 Claims, 4 Drawing Sheets

(56) References Cited

U.S. PATENT DOCUMENTS

| | | | | |
|---|---|---|---|---|
| 6,450,000 | B2 | 9/2002 | Barten | 72/201 |
| 8,281,632 | B2 | 10/2012 | Uijtdebroeks et al. | 72/201 |
| 2001/0027672 | A1 | 10/2001 | Barten | 72/201 |
| 2012/0031159 | A1* | 2/2012 | Seidel | B21B 27/10 72/6.2 |
| 2013/0305799 | A1* | 11/2013 | Ogawa | B21B 28/04 72/39 |
| 2019/0308233 | A1 | 10/2019 | Opitz et al. | |

FOREIGN PATENT DOCUMENTS

| | | | | |
|---|---|---|---|---|
| CN | 202238899 | U | | 5/2012 |
| CN | 104874614 | A | | 9/2015 |
| CN | 108927409 | A | * | 12/2018 |
| DE | 200 06 508 | U1 | | 8/2000 |
| DE | 10 2009 053 073 | A1 | | 9/2010 |
| DE | 10 2009 053 074 | A1 | | 9/2010 |
| EP | 3 308 868 | A1 | | 4/2018 |
| RU | 2483817 | C1 | | 6/2013 |
| SU | 900894 | A1 | | 1/1982 |
| SU | 1227275 | A1 | | 4/1986 |
| WO | WO 2008/149195 | A1 | | 12/2008 |
| WO | WO 2018/073086 | A1 | | 4/2018 |

OTHER PUBLICATIONS

Written Opinion ated Aug. 9, 2019 in corresponding PCT International Application No. PCT/EP2019/067939.

European Search Report dated Jan. 15, 2019 in corresponding European Patent Application No. 18185862.2.

Z. Koont et al., "Implementation of High Turbulence Roll Cooling at ArcelorMittal Dofasco's Hot Strip Mill," Iron and Steel Technology, Nov. 2014, pp. 43-51.

Chinese Office Action, dated Jun. 1, 2022, issued in corresponding Chinese Patent Application No. 201980049887.4.

* cited by examiner

ROLL STAND HAVING A HYBRID COOLING DEVICE

CROSS-REFERENCE TO RELATED APPLICATIONS

The present application is a 35 U.S.C. §§ 371 national phase conversion of PCT/EP2019/067939, filed Jul. 4, 2019, the contents of which are incorporated herein by reference, which claims priority of European Patent Application No. 18185862.2, filed Jul. 26, 2018, the contents of which are incorporated by reference herein. The PCT International Application was published in the German language.

TECHNICAL FIELD

The present invention is based on a roll stand for rolling flat metal rolling stock,

- wherein the roll stand has an upper working roller and a lower working roller which form a rolling gap between them,
- wherein the flat rolling stock runs through the rolling gap in a transport direction during the rolling of the flat rolling stock,
- wherein an upper cooling device, which cools the upper working roller, is arranged on the outlet side of the roll stand,
- wherein the upper cooling device has an upper spray boom which extends parallel to the upper working roller and has a plurality of upper spray nozzles which spray a liquid coolant onto the upper working roller,
- wherein the upper cooling device has a lower spray boom which extends parallel to the upper working roller and has a plurality of lower spray nozzles which spray the liquid coolant onto the upper working roller,
- wherein the lower spray boom is arranged between the flat rolling stock and the upper spray boom, and
- wherein at least some of the upper spray nozzles as a rule all upper spray nozzles, are designed as flat-jet nozzles.

PRIOR ART

Such roll stands are generally known. Reference can be made purely by way of example to U.S. Pat. No. 8,281,632 B2, in particular to the embodiments described as prior art therein.

During hot-rolling of flat rolling stock made of metal, for example steel, the working rollers heat up. For various technological reasons, for example for targeted influencing of the thermal crown and for minimizing wear, the working rollers are cooled. Intensive cooling is therefore required in order in particular for the heat supplied via the flat rolling stock to be removed again from the working rollers. Various embodiments are known for cooling the working rollers.

It is thus for example in U.S. Pat. No. 8,281,632 B2 that each of the upper and lower working rollers is assigned a water box which is in close contact with the respective working roller on the outlet side of the roll stand. The respective water box generates a turbulent water flow which efficiently cools the working rollers. A disadvantage of this teaching is that the water boxes have to be positioned very precisely in relation to the working rollers. If the distance is too small, there is the risk of damage to the working rollers and/or to the water boxes. If the distance is too large, efficient cooling cannot take place.

A similar procedure can be found in DE 10 2009 053 074 A1. The same applies for WO 2008/149 195 A1 and also for the specialist paper "Implementation of High Turbulence Roll Cooling at ArcelorMittal Dofasco's Hot Strip Mill" by Zafer Koont, published in Iron and Steel Technology, November 2014, pages 43 to 51.

EP 3 308 868 A1 discloses a roll stand in which a single cooling boom is arranged on the outlet side of the roll stand. The cooling boom has a plurality of rows of spray nozzles, and the rows extend in the width direction of the rolling stock or parallel to the working rollers. The spray nozzles of the rows are designed as full-jet nozzles. Although this embodiment allows intensive cooling of the working rollers, a considerable degree of complexity is required to ensure uniform cooling over the entire width of the working rollers.

The most frequent embodiment is the one stated at the outset. Its advantages are in particular the relatively simple construction and the operational reliability.

SUMMARY OF THE INVENTION

The roll stands have additional elements. One additional element is an upper wiping element which applies the coolant to the upper working roller on the outlet side is scraped off the upper working roller. The wiping element is required to prevent the coolant from running down onto the flat rolling stock in an uncontrolled manner and influencing its temperature in an uncontrolled manner.

Above the upper wiping element, a pool of the liquid coolant is frequently formed. This pool negatively influences the cooling by the flat-jet nozzles. The desired cooling of the upper working roller can therefore often be implemented only with difficulty.

The object of the present invention is to configure a roll stand of the type stated at the outset in such a way that, in combination with a simple structure, a highly efficient and uniform cooling of the upper working roller can be achieved.

According to the invention, a roll stand of the type stated at the outset is configured by at least some of the lower spray nozzles, and as a rule all lower spray nozzles, being designed as full-jet nozzles.

Full-jet nozzles are spray nozzles which emit a substantially straight coolant jet. The coolant jet usually has a circular or virtually circular cross section. The cross section varies only to a very minor extent with the distance from the full-jet nozzle. In particular, an opening angle of the emitted coolant jet is at most 5°. By contrast, flat-jet nozzles have a spray pattern in which the emitted coolant jet widens in a fan-like manner. The opening angle of the fan is at least 20°. In practice, it is usually 40° or more. The coolant emitted by a flat-jet nozzle thus strikes the upper working roller substantially in the form of an elongate line.

As a result of the bundled emission of the coolant, and for the same coolant pressure in the respective spray boom, full-jet nozzles generate a considerably higher impact pressure on the working roller than flat-jet nozzles. The higher impact pressure produces not only a higher cooling action. Of special importance in particular, is the fact that the full jet is also capable of completely penetrating the pool of coolant that may have formed on the upper wiping element.

In the simplest case, exclusively the upper and the lower spray booms are assigned to the upper working roller on the outlet side. Alternatively, however, it is possible for the roll stand to have at least one central spray boom. The at least one central spray boom is in this case arranged between the upper and the lower spray booms. It extends parallel to the upper working roller and has a plurality of central spray nozzles which spray the liquid coolant onto the upper working roller. The central spray nozzles of each central spray boom are as a rule, at least in a central region of the respective central spray boom, designed either uniformly as flat-jet nozzles or uniformly as full-jet nozzles. If it is for example that two central spray booms are present, it is possible for the spray nozzles of both central spray booms to be designed uniformly as flat-jet nozzles. Alternatively, it is possible for the spray nozzles of both central spray booms to be designed uniformly as full-jet nozzles. Again alternatively, it is possible for the spray nozzles of the one central spray boom to be designed uniformly as flat-jet nozzles, and for the spray nozzles of the other central spray boom to be designed uniformly as full-jet nozzles. By contrast, an embodiment in which the spray nozzles of one central spray boom are partially designed as flat-jet nozzles and partially designed as full-jet nozzles is indeed possible, but not preferred.

The upper spray boom, the central spray booms and the lower spray boom form a sequence of spray booms as viewed from the top down. A change from flat-jet nozzles to full-jet nozzles preferably occurs only a single time within the sequence of spray booms for regions of the spray booms that correspond to one another in the width direction of the flat rolling stock. If thus for example the spray nozzles are designed as full-jet nozzles in a specific central spray boom, it is also preferable that the spray nozzles are designed as full-jet nozzles in each further spray boom that is situated below this central spray boom. In an analogous manner, if the spray nozzles are designed as flat-jet nozzles in a specific central spray boom, it is preferable that the spray nozzles are designed as flat-jet nozzles in each further spray boom that is situated above this central spray boom.

Flat-jet nozzles are as a rule operated at a relatively high working pressure, which can be up to 20 bar. By contrast, full-jet nozzles can be operated at a lower pressure. It is therefore preferable for the coolant supplied to the full-jet nozzles to be applied at a first working pressure and for the coolant supplied to the flat-jet nozzles to be applied at a second working pressure. The first working pressure is as a rule less than the second working pressure. For example, the first working pressure can be at most 5 bar, whereas the second working pressure is at least 6 bar. It is customary to have a first working pressure of 1 to 4 bar, in particular of 2 to 3 bar, whereas the second working pressure is as a rule between 10 and 20 bar, and usually between 12 and 16 bar. However, other working pressures are also possible, for example a first working pressure of approximately 7 bar and a second working pressure of approximately 8 bar. In individual cases, the first working pressure can even be greater than the second working pressure. It is also possible for the coolant supplied to the full-jet nozzles and the coolant supplied to the flat-jet nozzles to be applied at a uniform working pressure. This working pressure can be up to 10 bar.

BRIEF DESCRIPTION OF THE DRAWINGS

The above-described properties, features and advantages of this invention and also the manner in which they are achieved will become clearer and more readily understandable in connection with the following description of the exemplary embodiments which will be explained in more detail in conjunction with the drawings, in which, in schematic illustration.

DESCRIPTION OF THE EMBODIMENTS

Figure 1:
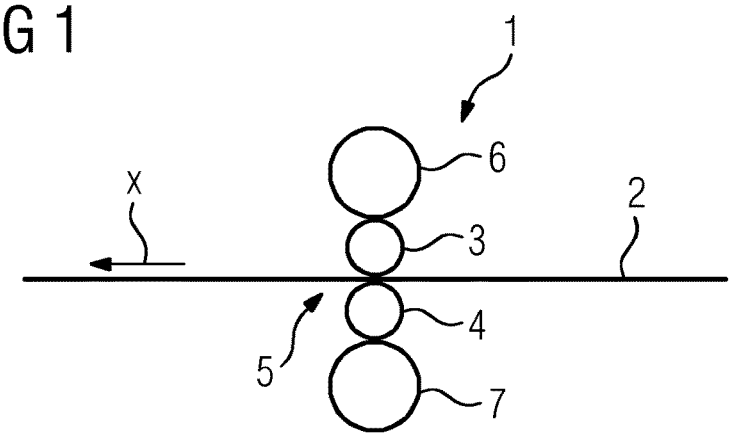
FIG. 1 shows a roll stand.

According to FIG. 1, it is intended for flat rolling stock 2 to be rolled by means of a roll stand 1. The flat rolling stock 2 can alternatively be a strip or a plate. The flat rolling stock 2 consists of metal, for example of steel, aluminum or copper. In order to roll the flat rolling stock 2, the roll stand 1 has at least one upper working roller 3 and one lower working roller 4. The working rollers 3, 4 are those rollers of the roll stand 1 that directly contact and form the flat rolling stock 2 during rolling. The working rollers 3, 4 thus form between them a rolling gap 5 through which the flat rolling stock 2 runs in a transport direction x during the rolling of the flat rolling stock 2.

The roll stand 1 can be a constituent part of a multi-stand rolling train, for example of a finishing train. In this case, the transport direction x is as a rule fixedly prescribed and the same in each rolling operation. This configuration is particularly the rule for a metal strip. Alternatively, the roll stand 1 can be designed as a reversing roll stand. In this case, the transport direction x reverses from rolling pass to rolling pass. Reversing stands are used in particular for rolling plate. However, they are sometimes also used for rolling metal strip, for example during rough rolling or in a Steckel mill.

In addition to the working rollers 3, 4, the flat rolling stock 2 as a rule has at least one upper and one lower backup roller 6, 7. It is also sometimes possible for further rollers to be present, for example an upper and a lower intermediate roller in the case of a six-high stand. The backup rollers 6, 7 and where appropriate also the intermediate rollers are of minor importance within the context of the present invention. It is also of minor importance within the context of the present invention whether the working rollers 3, 4 and/or any present intermediate rollers are axially displaceable. Therefore, no more detailed discussion will be given below in relation to the backup rollers 6, 7, the intermediate rollers and the axial displaceability of working rollers 3, 4 and/or intermediate rollers.

Figure 2:
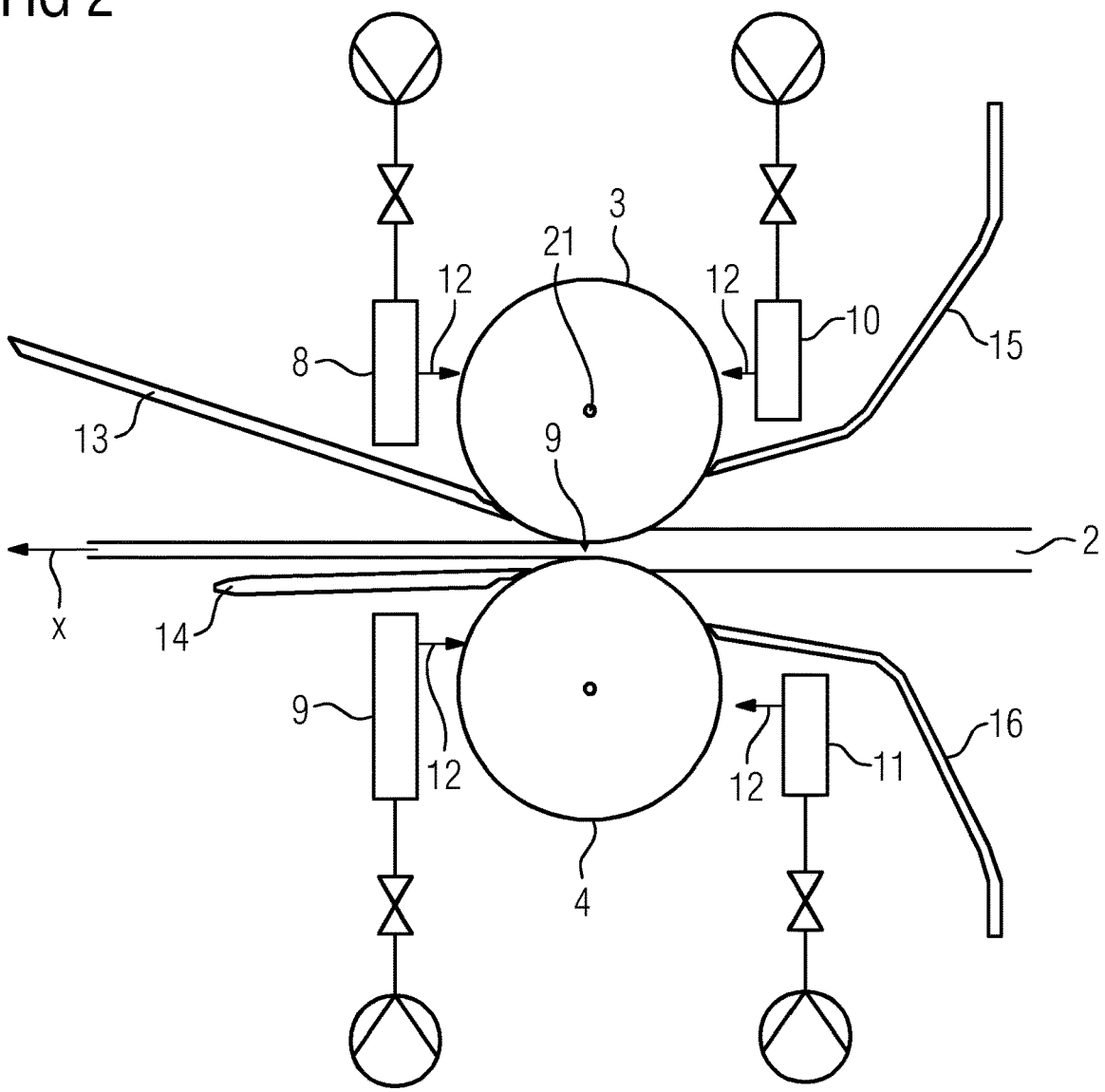
FIG. 2 shows working rollers of the roll stand from FIG. 1 and cooling devices for the working rollers.

According to FIG. 2, an upper cooling device 8 and a lower cooling device 9 are arranged at least on the outlet side of the roll stand 1. The upper working roller 3 can be cooled on the outlet side by means of the upper cooling device 8, and the lower working roller 4 can be cooled on the outlet side by means of the lower cooling device 9. It is often also the case that corresponding cooling devices 10, 11 are arranged on the inlet side of the roll stand 1. In order to cool the respective working roller 3, 4, a liquid coolant 12 is applied to the upper or the lower working roller 3, 4 by means of the respective cooling device 8 to 11. The liquid coolant 12 is water or contains, at least as its main constituent part, water, usually in an amount of up to above 95%, for example up to 99% or more.

Furthermore, each present cooling device 8 to 11 is assigned a wiping element 13 to 16. The respective wiping element 13 to 16 allows the liquid coolant 12 applied to the respective working roller 3, 4 to be scraped off the respective working roller 3, 4 in order that it does not get onto the flat rolling stock 2. Of decisive importance within the context of the present invention is the configuration of the upper cooling device 8 arranged on the outlet side of the roll stand 1. Although it is possible for the upper cooling device 10 arranged on the inlet side of the roll stand 1 to be designed in the same way, it can equally also be designed in some other way. It is only if the roll stand 1 is operated as a reversing stand that this cooling device 10 also has to be designed in the same way since the inlet side and outlet side are alternated in each rolling pass with respect to the preceding rolling pass. It is equally possible for the lower cooling devices 9, 11 to be designed in a similar manner to the upper cooling devices 8, 10. In this case, the statements below pertaining to the configuration of the upper cooling device 8 would apply in mirror-image fashion. However, they can also be designed in some other ways. Since the configuration of the lower cooling devices 9, 11 and of the cooling devices 10, 11 arranged on the inlet side of the roll stand 1 is of minor importance within the context of the present invention, only the upper cooling device 8 arranged on the outlet side of the roll stand 1 will be explained in more detail below.

Figure 3:
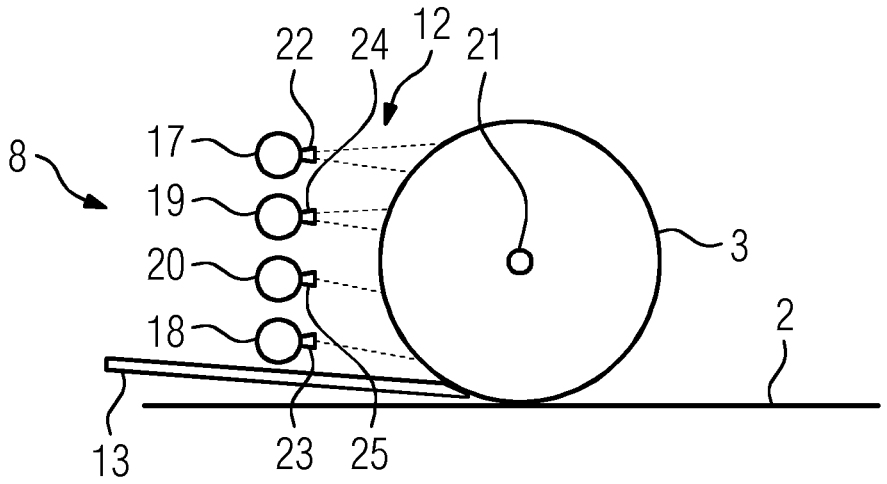
FIG. 3 shows an upper working roller with associated outlet-side cooling device.

According to FIG. 3, the upper cooling device 8 arranged on the outlet side of the roll stand 1 has at least one upper spray boom 17 and one lower spray boom 18. The lower spray boom 18 is arranged between the flat rolling stock 2 and the upper spray boom 17 during rolling of the flat rolling stock 2. In some cases, the upper and the lower spray booms 17, 18 are the sole spray booms 17, 18 of the cooling device 8. In other cases, central spray booms 19, 20 are additionally present. If they are present, the central spray booms 19, 20 are arranged between the upper and the lower spray booms 17, 20. The number of central spray booms 19, 20 is usually one or two. More than a total of four spray booms 17 to 20 are as a rule not present.

The spray booms 17 to 20 extend parallel to the upper working roller 3. Directions of extent of the spray booms 17 to 20 thus run parallel to the axis of rotation 21 of the upper working roller 3. Each spray boom 17 to 20 has a plurality of spray nozzles 22 to 25. The spray nozzles 22 to 25 are arranged next to one another as viewed in the direction of extent of the respective spray boom 17 to 20. The liquid coolant 12 is sprayed onto the upper working roller 3 by means of the spray nozzles 22 to 25. The spray nozzles 22 of the upper spray boom 17 are referred to below as upper spray nozzles 22, and the spray nozzles 23 of the lower spray boom 18 as lower spray nozzles. Likewise, the spray nozzles 24, 25 of the central spray booms 19, 20 are referred to as central spray nozzles. Distinguishing them as upper, lower and central spray nozzles 22 to 25 serves only for assigning them to the respective spray boom 17 to 20. No further significance is ascribed to the referencing.

Figure 4:
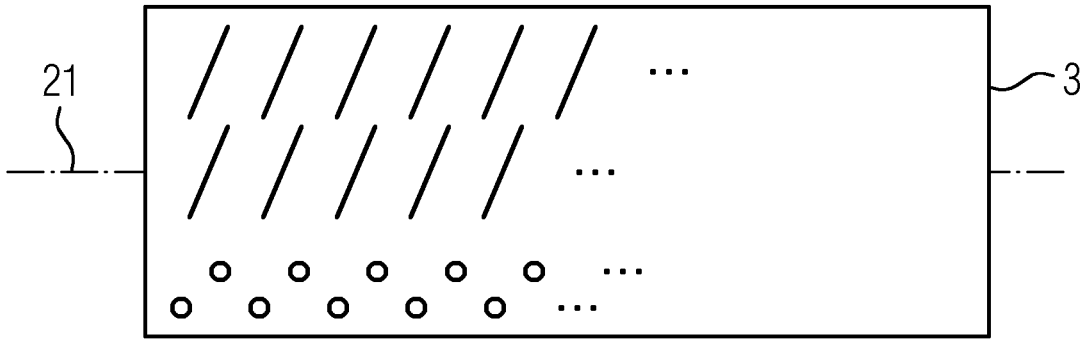
FIG. 4 shows a spray pattern.

FIG. 4 shows the spray pattern brought about by the spray nozzles 22 to 25 of the spray booms 17 to 20. It is evident from the illustration in FIG. 4 that the spray nozzles 22 to 25 are arranged equidistantly as viewed in the direction of extent of the spray booms 17 to 20. However, it is also possible to provide a non-equidistant arrangement. For example, it may be expedient under certain circumstances to provide larger spacings at the lateral edges. It is furthermore possible for the spray nozzles 22 to 25 of the respective spray boom 17 to 20 to be combined into groups of adjacent spray nozzles 22 to 25 such that each individual group of spray nozzles 22 to 25 can be activated independently.

Figure 5:
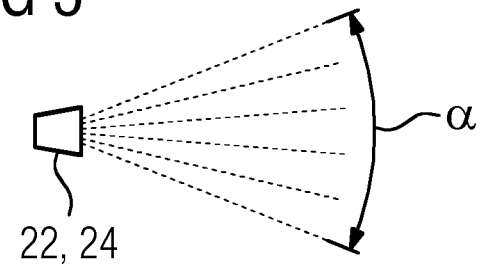
FIGS. 5 to 7 show spray nozzles and their associated jets.
Figure 6:
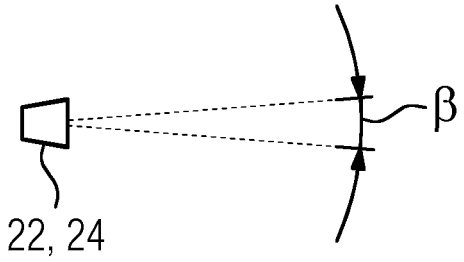

FIG. 4 also reveals that the upper spray nozzles 22 are designed as flat-jet nozzles. In accordance with the illustration in FIGS. 5 and 6, flat-jet nozzles are spray nozzles which widely fan out the liquid jet emitted by them in one direction, whereas in the other direction only very narrow fanning out occurs. According to FIG. 5, an opening angle $\alpha$ in the direction in which the liquid jet is fanned out is at least 20°, usually 40° or more. According to FIG. 6, an opening angle $\beta$ orthogonal thereto in which the liquid jet is not fanned out is at most 3°, usually 1° to 2°.

Figure 7:
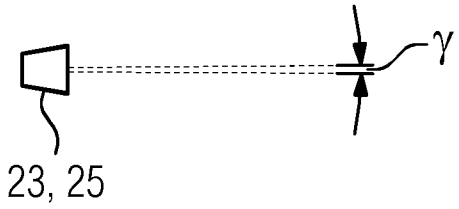

FIG. 4 also reveals that the lower spray nozzles 23 are designed as full-jet nozzles. In accordance with the illustration in FIG. 7, full-jet nozzles are spray nozzles which fan out the liquid jet emitted by them as little as possible. Ideally, an opening angle $\gamma$ is 0°. In practice, it is usually 1° to 2°, but at most 5°. The opening angle $\gamma$ is as a rule independent of the plane which is observed.

In the embodiment according to FIG. 4, the spray nozzles 22, 23 of the upper and of the lower spray boom 17, 18 are each uniformly designed as flat-jet nozzles or as full-jet nozzles. However, in the individual case, the upper spray boom 17, in particular at its edges as viewed in the width direction of the flat rolling stock 2, can also have other than flat-jet nozzles. In an analogous manner, the lower spray boom 18, in particular at its edges as viewed in the width direction of the flat rolling stock 2, can also have other than full-jet nozzles.

The central spray nozzles 24, 25 can be designed as flat-jet nozzles or as full-jet nozzles as required. However, each central spray boom 19, 20 preferably has only a single type of spray nozzles, that is to say either flat-jet nozzles or full-jet nozzles, but not mixed flat-jet nozzles and full-jet nozzles. At least, this statement applies as viewed in the width direction of the flat rolling stock 2 in a central region of the respective central spray boom 19, 20. With respect to in each case one of the central spray booms 19, 20, the spray nozzles 24, 25 of the respective central spray boom 19, 20 are thus designed uniformly.

The spray booms 17 to 20 form as viewed from the top down a sequence of spray booms 17, 19, 20, 18. A change from flat-jet nozzles to full-jet nozzles preferably occurs only a single time within the sequence of spray booms 17, 19, 20, 18. It is thus possible for the spray nozzles 24, 25 of both central spray booms 19, 20 to be designed as full-jet nozzles. In this case, the change from flat-jet nozzles to full-jet nozzles occurs at the transition from the upper spray boom 17 to the upper central spray boom 19. It is equally possible for the spray nozzles 24, 25 of both central spray booms 19, 20 to be designed as flat-jet nozzles. In this case, the change from flat-jet nozzles to full-jet nozzles occurs at the transition from the lower central spray boom 20 to the lower spray boom 18. It is equally possible for the spray nozzles 24, 25 of in each case one of the two central spray booms 19, 20 to be designed as flat-jet nozzles and as full-jet nozzles. In this case, the change from flat-jet nozzles to full-jet nozzles occurs in accordance with the illustration in FIG. 3 at the transition from the upper central spray boom 19 to the lower central spray boom 20. Although an embodiment in which the spray nozzles 24 of the upper central spray boom 19 are designed as full-jet nozzles, and the spray nozzles 25 of the lower central spray boom 20 are designed as flat-jet nozzles, is possible in principle, it should be avoided as far as possible. At least, these statements apply to regions of the spray booms 17, 19, 20, 18 that correspond to one another in the width direction of the flat rolling stock 2.

It is furthermore evident from FIGS. 3 and 4 that the regions of the upper working roller 3 that are sprayed by in each case one of the spray nozzles 22 to 25 are disjoint from the regions that are sprayed by the other spray nozzles 22 to 25. Each individual spray nozzle 22 to 25 thus individually sprays a respective region of the upper working roller 3, wherein the regions are disjoint from one another. By contrast, it is by all means possible for the spray nozzles 22, and possibly also 24 and 25, designed as flat-jet nozzles to apply the coolant neither horizontally nor vertically but, in accordance with the illustration in FIG. 4, obliquely, with the result that there is a certain overlap in the vertical direction.

Figure 8:
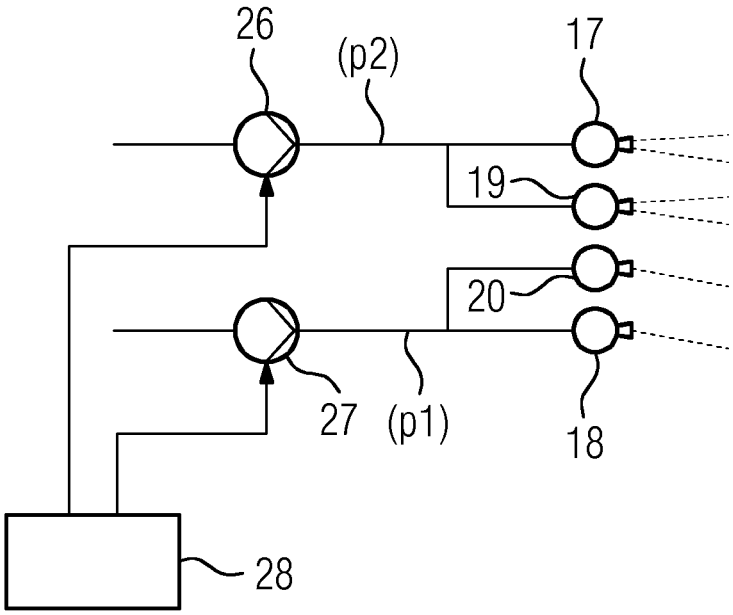
FIG. 8 shows the supply of spray nozzles with coolant.

With respect to the operation of the cooling device 8, in accordance with the illustration in FIG. 8, it is possible for the liquid coolant 12 to be applied at a first working pressure p1 insofar as it is supplied to the full-jet nozzles, that is, according to the exemplary embodiment, the lower spray nozzles 23 and the central spray nozzles 25 of the lower central spray boom 20. In an analogous manner, the liquid coolant 12 can be applied at a second working pressure p2 insofar as it is supplied to the flat-jet nozzles, that is, according to the exemplary embodiment, the upper spray nozzles 22 and the central spray nozzles 24 of the upper central spray boom 20. For example, corresponding pumps 26, 27 can be present for this purpose. The first working pressure p1 can be set for example by a control device 28 by corresponding activation of the pump 26. The second working pressure p2 can be set for example by the control device 28 by corresponding activation of the pump 27. It is equally possible for the setting of the working pressure p1 and/or of the working pressure p2 or of the volumetric flow to occur for example via control valves.

The two working pressures p1, p2 can be set independently of one another by the control device 28. However, in the embodiment according to FIG. 8, the first working pressure p1 is less than the second working pressure p2. For example, the first working pressure p1 can be approximately 5 bar, in particular approximately 2 bar to 3 bar. By contrast, the second working pressure p2 is preferably at least 6 bar, for example approximately 12 bar to 16 bar.

Figure 9:
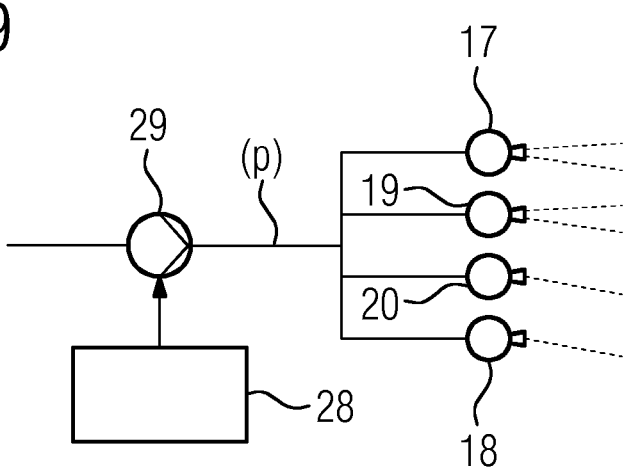
FIG. 9 shows a further supply of spray nozzles with coolant.

Alternatively, it is possible, in accordance with the illustration in FIG. 9, for the liquid coolant 12 to be applied at a uniform working pressure p regardless of whether the coolant is supplied to the full-jet nozzles or to the flat-jet nozzles. For example, a common pump 29 can be present for this purpose. In this case, the common working pressure p can be set by the control device 28 by corresponding activation of the pump 29. The working pressure p is in this case preferably at most 10 bar. It can in particular be—analogously to the first working pressure p1—approximately 2 bar to 3 bar.

The present invention has many advantages. In particular, the lower region of the upper working roller 3 can be effectively cooled even when a liquid pool has formed on the associated wiping element 13. Furthermore, it is also possible in a simple manner for a conventional cooling arrangement (not according to the invention) of an existing roll stand 1 to be correspondingly retrofitted. All that is required is for the already present lowermost spray boom to be removed and replaced by a lower spray boom 17 according to the invention. Furthermore, the angular range over which the cooling occurs can be maximized as viewed in the circumferential direction of the upper working roller 3. In particular, the cooling can be begun already directly above the upper wiping element 13 arranged on the outlet side of the roll stand 1.

Although the invention has been more fully illustrated and described in detail by way of the preferred exemplary embodiment, the invention is thus not limited by the disclosed examples and other variants can be derived therefrom by a person skilled in the art without departing from the scope of protection of the invention.

LIST OF REFERENCE SIGNS

1 roll stand
2 flat rolling stock
3, 4 working rollers
5 rolling gap
6, 7 backup rollers
8 to 11 cooling devices
12 liquid coolant
13 to 16 wiping elements
17 to 20 spray booms
21 axis of rotation
22 to 25 spray nozzles
26, 27, 29 pumps
28 control device
p, p1, p2 working pressures
x transport direction
α, β, γ opening angles

The invention claimed is:

1. A roll stand for rolling flat metal rolling stock, comprising:

an upper working roller and a lower working roller which between them form a rolling gap configured so that the flat rolling stock is run through the rolling gap in a transport direction (x) during the rolling of the flat rolling stock;

an upper cooling device configured for cooling the upper working roller; an outlet side, the upper cooling device is arranged on the outlet side;

the upper cooling device has an upper spray boom which extends parallel to the upper working roller and has a plurality of upper spray nozzles configured for spraying a liquid coolant onto the upper working roller;

the upper cooling device has a lower spray boom which extends parallel to the upper working roller, the lower spray boom has a plurality of lower spray nozzles configured for spraying the liquid coolant onto the upper working roller, and the lower spray boom is arranged between the flat rolling stock and the upper spray boom;

at least some of the upper spray nozzles are configured as flat-jet nozzles;

at least some of the lower spray nozzles are configured as full-jet nozzles;

a first pump that supplies the coolant to the lower spray nozzles at a first working pressure (p1);

a second pump that supplies the coolant to the upper spray nozzles at a second working pressure (p2);

a control device that sets the first working pressure (p1) lower than the second working pressure (p2), and an upper scraping element positioned lower than the lower spray nozzles that, in operation, collects coolant thereon to form a pool of coolant, wherein, in operation, the full-jet nozzles of the lower spray nozzles spray the liquid coolant to completely penetrate a pool of coolant formed on the upper scraping element, wherein the full jet nozzles are capable of discharging a coolant jet with an opening angle of at most 5°.

2. The roll stand as claimed in claim 1, further comprising:

at least one central spray boom arranged between the upper and the lower spray booms, the central spray boom extends parallel to the upper working roller;

the central spray boom has a plurality of central spray nozzles configured for spraying the liquid coolant onto the upper working roller; and the central spray nozzles of each central spray boom are configured, at least in a central region of the respective central spray boom, either uniformly as flat-jet nozzles or uniformly as full-jet nozzles.

3. The roll stand as claimed in claim 2, wherein the upper spray boom, the central spray boom and the lower spray boom form a sequence of spray booms as viewed from a top of the roll stand down; and a change from flat-jet nozzles to full-jet nozzles occurs a single time within the sequence of spray booms for regions of the spray booms, wherein the regions of the spray booms correspond to one another in a width direction of the flat rolling stock.

4. The roll stand as claimed in claim 1, wherein the first working pressure (p1) is at most 5 bar, and the second working pressure (p2) is at least 6 bar.

5. A roll stand for rolling flat metal rolling stock, comprising:

an upper working roller and a lower working roller which between them form a rolling gap configured so that the flat rolling stock is run through the rolling gap in a transport direction (x) during the rolling of the flat rolling stock;

an upper cooling device configured for cooling the upper working roller;

an outlet side, the upper cooling device is arranged on the outlet side;

the upper cooling device has an upper spray boom which extends parallel to the upper working roller and has a plurality of upper spray nozzles configured for spraying a liquid coolant onto the upper working roller;

the upper cooling device has a lower spray boom which extends parallel to the upper working roller, the lower spray boom has a plurality of lower spray nozzles configured for spraying the liquid coolant onto the upper working roller, and the lower spray boom is arranged between the flat rolling stock and the upper spray boom;

at least some of the upper spray nozzles comprising are configured as flat-jet nozzles;

at least some of the lower spray nozzles comprising are configured as full jet nozzles;

a first pump that supplies the coolant to the lower spray nozzles at a first working pressure (p1);

a second pump that supplies the coolant to the upper spray nozzles at a second working pressure (p2);

a control device that sets the first working pressure (p1) lower than the second working pressure (p2); and an upper scraping element positioned lower than the lower spray nozzles that, in operation, collects coolant thereon to form a pool of coolant;

at least one central spray boom arranged between the upper and the lower spray booms, the central spray boom extends parallel to the upper working roller;

the central spray boom has a plurality of central spray nozzles configured for spraying the liquid coolant onto the upper working roller; and the central spray nozzles of the at least one spray boom are configured, at least in a central region thereof, either uniformly as flat-jet nozzles or uniformly as full-jet nozzles, wherein the upper spray boom, the at least one central spray boom, and the lower spray boom form a sequence of spray booms as viewed from a top of the roll stand down, wherein, in the sequence, the nozzles change from flat-jet nozzles in the upper spray boom to full jet nozzles in the lower spray boom, wherein the change from the flat-jet nozzles to the full-jet nozzles occurs only one time within the sequence of spray booms for each region of regions of the spray booms, wherein the regions of the spray booms correspond to one another in a width direction of the flat rolling stock, wherein, in operation, the full-jet nozzles of the lower spray nozzles spray the liquid coolant to completely penetrate a pool of coolant formed on the upper scraping element.

* * * * *